United States Patent [19]

Steel

[11] Patent Number: 5,040,611

[45] Date of Patent: Aug. 20, 1991

[54] AIRCRAFT FIRE PROTECTION SYSTEM

[75] Inventor: James Steel, Dalton, United Kingdom

[73] Assignee: Darchem, Ltd., Durham, England

[21] Appl. No.: 569,220

[22] Filed: Aug. 16, 1990

Related U.S. Application Data

[63] Continuation of Ser. No. 313,295, Feb. 21, 1989, abandoned, which is a continuation of Ser. No. 923,868, Oct. 28, 1986, abandoned.

[51] Int. Cl.[5] ..... A62C 3/08

[52] U.S. Cl. ..... 169/62; 244/129.2

[58] Field of Search ..... 244/129.2; 169/62

[56] References Cited

U.S. PATENT DOCUMENTS

| | | | |
|---|---|---|---|
| 1,854,220 | 4/1932 | Pollard | 169/62 |
| 1,866,008 | 7/1932 | Burke, Jr. | 169/62 |
| 2,560,091 | 7/1951 | Davis | 169/62 |
| 2,938,687 | 5/1960 | Krapf, Jr. | 244/129.2 |
| 3,783,946 | 1/1974 | Petrinec et al. | 169/62 |
| 4,347,901 | 9/1982 | Wilhoit | 169/62 |
| 4,372,395 | 2/1983 | Hammett | 169/69 |

FOREIGN PATENT DOCUMENTS

| | | | |
|---|---|---|---|
| 2181050 | 4/1987 | United Kingdom | 169/62 |

OTHER PUBLICATIONS

K. R. Miniszewski and T. E. Waterman, *Fire Management/Suppression Systems/Concepts Relating to Cabin Fire Safety,* Oct. 1983, FAA Report, pp. 51–63.

*Primary Examiner*—Joseph F. Peters, Jr.
*Assistant Examiner*—Anne E. Bidwell

[57] ABSTRACT

An aircraft fire protection system which includes a plurality of water spray nozzles spaced along a plurality of longitudinal conduits all cross-connected by a plurality of transverse conduits, with "choking" type flow restrictors spaced between groups of spray nozzles to limit flow following conduit rupture. Conduits are connected to the aircraft on-board water supply system via a pump and non-return valve in series and, additionally or alternately, a plurality of externally mounted self-sealing couplings are interconnected to the conduits, one of which couplings should be accessible to fire-fighting personnel for fire tender hose hookup regardless of aircraft orientation and attitude. A two-way flow restrictor includes a housing with a captured ball valve element with flutes by-passing opposing seating shoulders for the ball to provide two predetermined "choked" flow rates for normal and reverse flow modes.

10 Claims, 3 Drawing Sheets

AIRCRAFT FIRE PROTECTION SYSTEMThis application is a continuation of application Ser. No. 07/313,295 filed February 21, 1989 which was a continuation of application Ser. No. 06/923,868 filed October 28, 1986, which are now both abandoned.

BACKGROUND OF THE INVENTION

1. Field of the Invention

The present invention relates to systems for the prevention of fires aboard aircraft, including aircraft which have crashed 2. Description of the Prior Art There are two principal major fire hazards in aircraft cabins, namely:

(a) In-flight fire in the cabin spaces; and (b) Fire on the ground, following a crash, which spreads into the cabin.

Both of these involve combustion of the fabric and furnishings inside the aircraft and the emission of toxic fumes. Hand-held fire extinguishers are of limited use in the in-flight fires and totally ineffective in the major fires which follow crashes. Internal spray systems have been proposed for commercial and military aircraft, but they have not been adopted because they require the aircraft to carry large quantities of water or other non-toxic extinguishing liquids and the weight penalty is unacceptable.

The majority of survivable crashes occur within the perimeter of an airfield and fire tenders are able to extinguish external fires within a matter of minutes. But in this brief period, a large number of passengers will have died from the effects of:

(a) Toxic fumes given off by the burning furnishings;

(b) External fumes ducted through the aircraft by the chimney effect;

(c) Flash-over fires in the aircraft furnishings; and (d) High temperature in the cabin.

SUMMARY OF THE INVENTION

The present invention makes it possible to operate a cabin spray system without the need to carry large additional quantities of water or other fluid in the aircraft. This is achieved by:

(a) The use of the aircraft's domestic water supply (fresh and used) to cope with in-flight fires during the immediate period following a crash; and/or (b) Pumping water from the ordinary hoses of the fire tenders into special connectors mounted at the extremities of the aircraft, one of which is certain to be accessible to the firemen.

Each of these two capabilities individually and especially in combination will provide the time necessary for safe aircraft evacuation. Some airlines or aircraft regulatory bodies may prefer to use a system having one or the other of the capabilities, but a system having the capabilities in combination would be expected to dramatically increase the chances for survival compared to aircraft without such protection.

In accordance with the present invention as embodied and broadly described herein, the fire protection system for an aircraft of the type having an on-board water supply system which comprises a plurality of spray nozzles dispersed throughout the aircraft passenger cabin and a plurality of distribution conduits interconnecting the plurality of spray nozzles. The system also includes means for selectively connecting the distribution conduits to the aircraft's on-board water supply system.

Preferably, the distribution conduits are configured to supply each of the plurality of spray nozzles along at least two alternate flow paths whereby a redundancy is achieved.

It is also preferred that the fire protection system further comprises means for limiting the flow of water in the distribution conduits in the event of a rupture in one of the distribution conduits upstream of one or more of the plurality of spray nozzles.

It is still further preferred that the fire protection system further comprises means for optionally connecting the distribution conduits to a source of pressurized water external to the aircraft, the external source connection means being positioned to be accessible to fire-fighting personnel outside the aircraft regardless of the orientation of the aircraft.

In accordance with the invention as embodied and broadly described herein, the fire protection system for an aircraft to be supplied with pressurized water from a source external to the aircraft comprises a plurality of spray nozzles dispersed throughout the aircraft passenger cabin; conduit means located internal to the aircraft interconnecting the plurality of spray nozzles; and at least one self-sealing coupling mounted on the external fuselage of the aircraft and being interconnected with the plurality of spray nozzles by the conduit means.

Further in accordance with the invention as embodied and broadly described herein, the apparatus for restricting the flow of a fluid in a conduit to a predetermined maximum value for a given fluid flow pressure drop comprises a flow restrictor housing having a through-bore, an enlarged bore portion within the housing, and an internal housing shoulder positioned at the juncture of the enlarged bore portion and the downstream part of the enlarged through-bore. The apparatus further includes a valve body positioned within the enlarged bore portion and movable by the action of the flowing fluid into abutment with the shoulder. Still further, the apparatus includes a set of flutes formed in the housing and spaced about the inner periphery of the enlarged bore position, the set of flutes by-passing the shoulder. The flutes are sized so that the combined cross-sectional flow area yields the desired fluid flow rate value for the given fluid flow pressure drop.

Summarizing the description of the aircraft fire protection system shown in the figures, and operation thereof depending upon the aircraft body size, preferably three or more longitudinal conduits 32, 34 are installed on each side within cabin 14. Sited at intervals along these pipes are spray nozzles 28, so disposed to provide complete coverage of the aircraft interior with finely dispersed droplets of water. The longitudinal conduits are supplied with water from feed inlets at the extremities of the aircraft. Thus, there are two self-sealing couplings 66 forward and two aft on the fuselage, and one self-sealing coupling 68 at each wing tip, each able to be supplied from the airfield fire tender's hose pipes, these being fitted with matching self-sealing couplings. The aircraft's couplings are installed in non-pressurized parts of the aircraft. Feeder pipes 67 from the couplings to the interior sprinkler system are led through standard bulkhead fittings where they pass through the pressurized bulkheads.

The longitudinal conduits 32, 34 and transverse conduits 36 in the cabin are of titanium to save weight. The flexible conduits 70 in the wings are of plastic, their flexibility making it easier to pass them through existing lightening holes in the wing ribs.

Self-sealing couplings 66, 68 are disposed so that some of the couplings will be accessible, regardless of the attitude of the aircraft. They will be supplied with water from the first sure of 9 bar (110 psi). However, the sprinkler system is effective provided the pressure is no less than 2.3 bar (35 psi).

Should one or both wings be sheared off in the accident, and plastic flexible conduits 70 thus become damaged, non-return valves 72 in the wing roots where the conduits join the internal conduit distribution system will close when water is applied to one or more of the other external hose couplings which remain serviceable. If the wing is intact, but on fire, then the plastic conduit will survive if it is full of water. If the plastic conduit 70 is destroyed by fire before it is filled with water via its respective coupling 68, then, again, any of the other couplings 66 can be used by the firemen to drench the cabin.

Should the accident cause a fracture of the conduits within the cabin, it will still be possible to achieve drenching of the cabin via the separate system parts. The sprinkler nozzles are arranged in groups along longitudinal conduits 32, 34, with flow restrictors 38 between those groups. The flow restrictors "choke", limiting the quantity of water which can spill from the fractured conduit ends to that quantity which would normally have been supplied to the sprayers on the broken-off section. This will ensure that all spray nozzles 28 supplied with water will function as intended. Flow restrictors 38 are of a novel but simple and reliable design which enables them to restrict to two different flow values, depending upon the direction of water flow. Thus, it is possible to ensure successful drenching of the cabin 14, no matter where along the conduit length a fracture occurs.

The weight of the system 10 is estimated as 45 kg (100 lb.) for a Boeing 737 installation, and this low figure would be acceptable to any airline interested in passenger safety.

BRIEF DESCRIPTION OF THE DRAWING

The appended drawing, which is considered a part of the present specification and which, in conjunction with the written portion of the specification, serves to explain the principles and operation of the aircraft fire control system of the present invention, includes the following figures.

DESCRIPTION OF THE PREFERRED EMBODIMENT

Reference will now be made to the present preferred embodiment of the invention, an example of which is depicted in the accompanying drawing.

Figure 1:
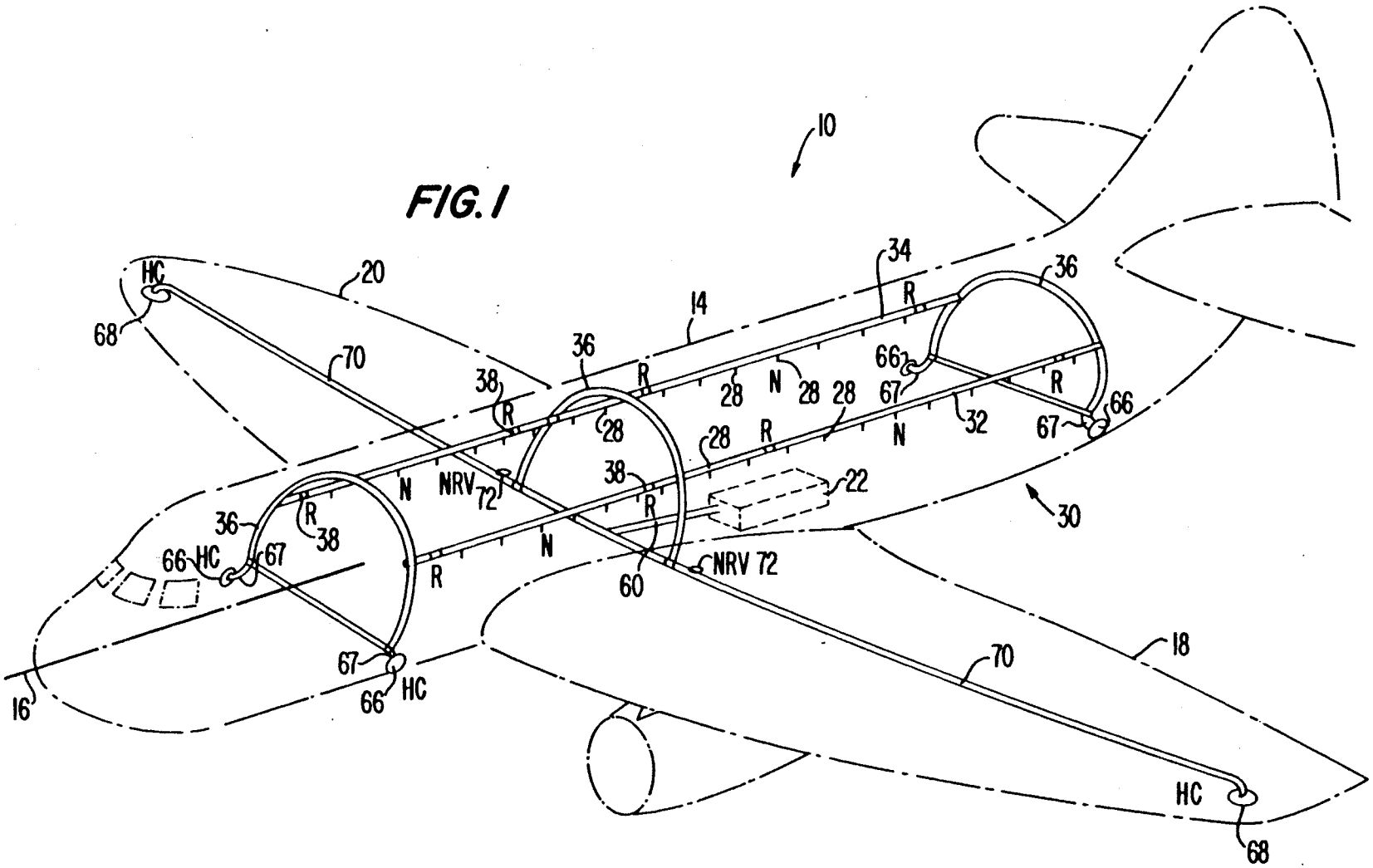
FIG. 1 is an overall schematic view of one embodiment of the aircraft fire control system, made in accordance with the present invention.
Figure 2:
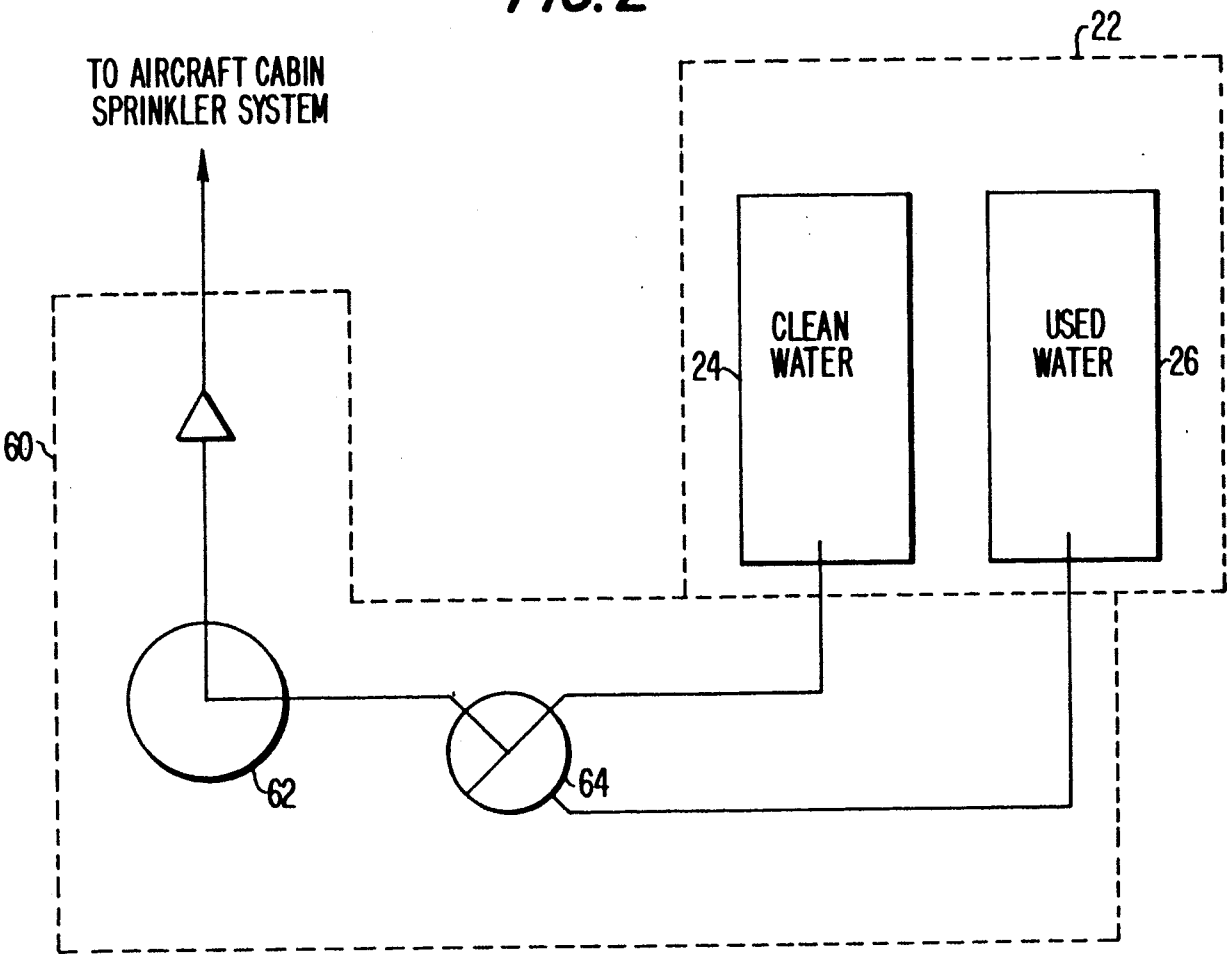
FIG. 2 is a schematic showing a portion of the aircraft fire control system depicted in FIG. 1.

With initial reference to FIG. 1, there is shown an aircraft fire protection system constructed in accordance with the present invention and designated generally by the numeral 10. Fire protection system 10 is shown installed in aircraft 12 (shown in dotted lines) having passenger cabin 14 disposed along the aircraft longitudinal axis 16 and wings 18, 20 defining the transverse direction. The aircraft depicted in FIG. 1 is of the type having an on-board "domestic" water supply system 22. As best seen in FIG. 2, domestic water supply system 22 includes clean water reservoir 24 and used water reservoir 26.

In accordance with the present invention, the aircraft fire protection system includes a plurality of spray nozzles dispersed throughout the aircraft cabin. As embodied herein, and as best seen in FIG. 1, a plurality of sprinkler heads 28 are arrayed along cabin 14 and directed to provide coverage to all occupied parts of cabin 14. The individual nozzles 28 can be directed from below, as well as from the side and from above, the passenger seating positions, and configured and sized to provide mist or shower-type sprays. Sprinkler heads should be operable at least over the range of water supply pressures of about 35 psi to 110 psi. One skilled in the art would be able to construct and position suitable sprinkler heads given current knowledge in the art and the present specification.

In accordance with the present invention, the aircraft fire protection system further includes conduit means for interconnecting and distributing water to the spray nozzles. As embodied herein, and with continued reference to FIG. 1, conduit means designated generally by the numeral 30 includes a plurality of longitudinal conduits 32, 34 running the length of cabin 14, with at least one longitudinal conduit on each transverse side of axis 16. Preferably, a plurality (e.g., three or more) of longitudinal conduits 32, 34 are used on each transverse side, although FIG. 1 only shows one each for purposes of clarity. Longitudinal conduits 32, 34 should be strong but relatively lightweight, and titanium conduits are preferred. These can be run along the non-pressurized space outside the cabin, with only the spray nozzles penetrating the pressurized portion.

Conduit means 30 further includes at least one transverse conduit 36 for interconnecting longitudinal conduits 32, 34. Preferably, a plurality of transverse conduits 36 (three being shown in FIG. 1), spaced along axis 16, are employed to achieve a redundancy in the water supply flow path to each spray nozzle 28. In this same vein, transverse conduits 36 are closed ring-type, which act like distribution plenums. In the event of an aircraft crash followed by rupture of one of longitudinal conduits 32, 34 and/or transverse conduits 36 there would exist an alternative flow to each spray nozzle 28, as can be appreciated from studying the configuration of conduit means 30 in FIG. 1.

To assist in achieving the flow path redundancy, flow restrictors 38 are placed in longitudinal conduits 32, 34 between groups of spray nozzles 28 to limit or "choke" the flow that would leak out of the ruptured conduit downstream of the restrictor. Preferably, flow restrictors 38 are sized to limit the rupture flow rate to approximately that of the combined downstream spray nozzle capacity, and it is further preferred that the flow restrictors be "two-way" to accommodate the alternate redundant flow path design. A novel flow restrictor 38, which is simple in design and which can be constructed to have two different choke flow rates, depending on flow direction, is discussed henceforth.

In accordance with the present invention, the two-way flow restrictor includes a housing with a throughbore and an enlarged bore portion capturingly holding a valve body. As embodied herein, and with reference to FIG. 3, flow restrictor 38 includes housing 40 with through-bore 42, a central portion 44 of which is enlarged in cross-sectional diameter. Respective internal shoulders 46, 48 are formed in the housing at the junctures of portions 50, 52 of the through-bore 42 and enlarged bore portion 44. Ball-type valve body 54 is positioned in enlarged bore portion 44 and is movable by action of the flowing fluid into engagement with either of shoulders 46, 48, depending upon the direction of fluid flow.

Figure 3B:
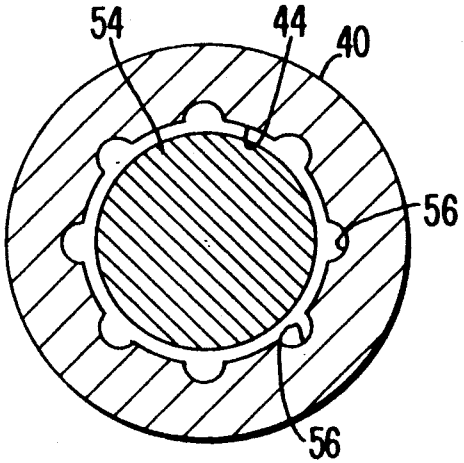
FIG. 3 is a schematic detail of the flow restrictor element of the aircraft fire control system depicted in FIG. 1.
Figure 3A:
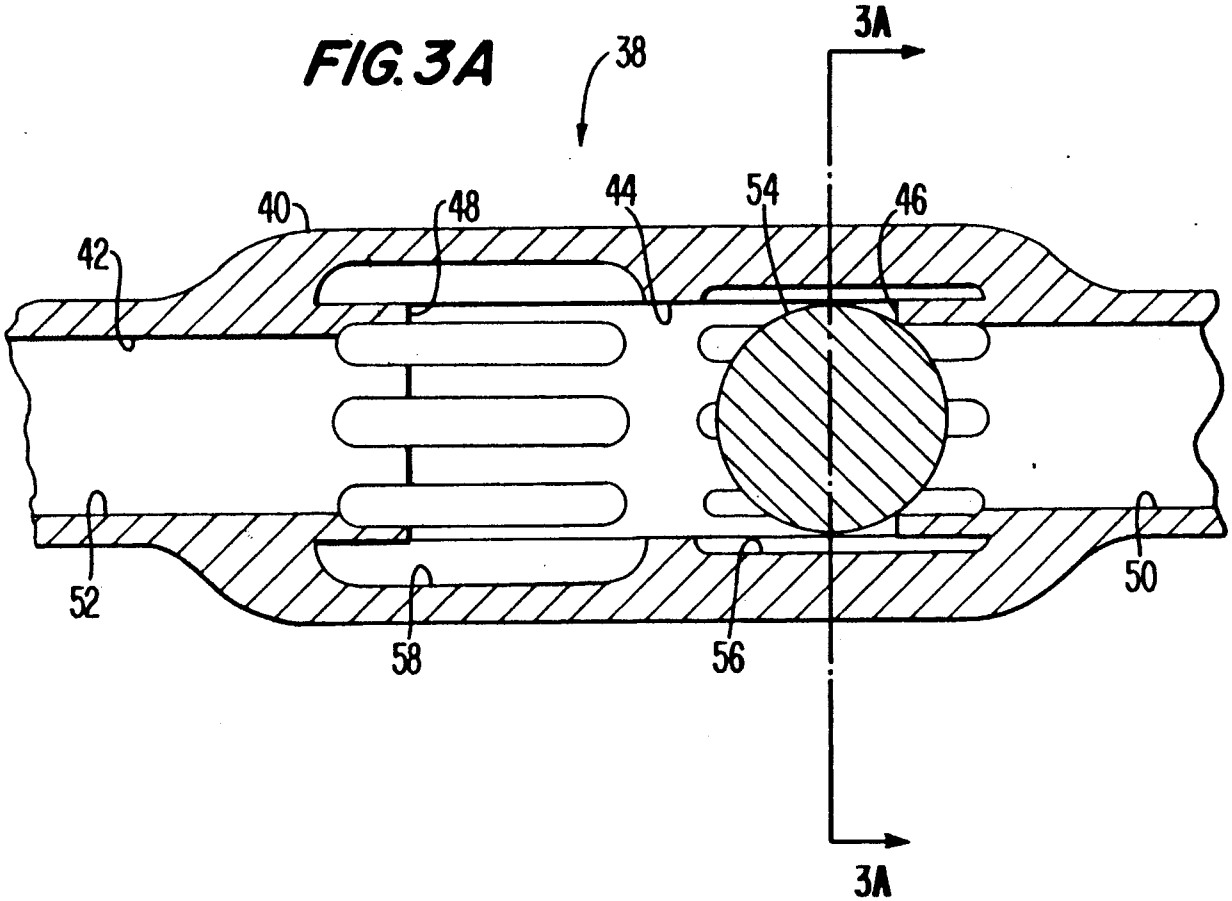

Importantly, and further in accordance with the present invention, flutes are provided spaced about the internal periphery of the housing and by-passing the respective shoulders to provide a predetermined flow path past the valve body. As embodied herein, two sets of flutes 56, 58 are formed in the internal periphery of housing 40 to by-pass shoulders 46, 48, respectively. As depicted in FIG. 3, the flutes in sets 56, 58 are of different size to provide a different preselected "choke" flow rate. Thus, the "choke" flow rate for fluid flow right to left in FIG. 3 would be greater than the "choke" flow rate in the opposite direction owing to the larger sizes of the flutes in set 58 relative to set 56. Alternatively, the number of flutes can be varied, while the flute size is kept constant, to achieve different "choke" flow rates, as one skilled in the art would immediately appreciate.

Still further in accordance with the present invention, the aircraft fire protection system includes means for selectively connecting said distribution conduits to the aircraft on-board water supply system. As embodied herein, and with initial reference to FIG. 1, selective connection means designated generally by the numeral 60 is shown connecting domestic water supply system 22 with the centrally located one of transverse ring-type conduits 36. Other connection locations are, of course, possible due to the interconnections of conduit means 30, as well as a connection between supply system 22 and one of longitudinal conduits 32, 34. With reference now to FIG. 2, selective connection means 60 can, for example, include water pump 62 and non-return valve 64 in series and changeover valve 64 selectively connectable to clean water reservoir 24, used water reservoir 26, individually, or both, simultaneously.

Further in accordance with the present invention, the aircraft fire protection system can also include means for optionally connecting the distribution conduits to a source of pressurized water external to the aircraft. As embodied herein, and with reference again to FIG. 1, a plurality of self-sealing couplings 66 are distributed about the external aircraft fuselage on both sides of the aircraft and are individually connected via feeder pipes 67 to transverse conduits 36 at the front and rear of the aircraft. This distribution should allow at least one of self-sealing couplings 66 to be accessible to fire fighting personnel for virtually any non-standard orientation of the aircraft, such as following a crash where the aircraft may be on its side or have some fuselage portions damaged. Additional self-sealing couplings 68 can be located at the wing tips and can be connected to the central one of transverse conduits 36 via flexible conduits 70 in which are disposed non-return valves 72 located near the wing roots due to the high propensity for the wings to be sheared off following a crash landing. Flexible conduits can be fabricated from plastic piping to provide the required flexibility.

What is claimed is:

1. A fire protection system for an aircraft of the type having an on-board domestic water supply system, the fire protection system comprising:

a) a plurality of spray nozzles dispersed throughout the aircraft passenger cabin;

b) a plurality of distribution conduits interconnecting said plurality of spray nozzles;

c) means for selectively connecting said distribution conduits to the aircraft on-board domestic water supply system;

d) means for optionally connecting said distribution conduits to a source of pressurized water external to the aircraft, said external source connection means being positioned to be accessible to fire-fighting personnel outside the aircraft regardless of the orientation of the aircraft, wherein said external water source connecting means comprises a plurality of self-sealing couplings distributed about the external fuselage of the aircraft and connected to said distribution conduits, and wherein said distribution conduits are configured for providing a flow path to each of said plurality of spray nozzles from each of said self-sealing couplings.

2. The fire protection system as in claim 1 wherein said distribution conduits include:

(i) a plurality of longitudinal conduits running along the longitudinal axis of the aircraft, at least one of said longitudinal conduits being located on each side of the aircraft, said spray nozzles being spaced along said longitudinal conduits; and (ii) at least one crossover conduit extending generally transverse to, and interconnecting with, said longitudinal conduits.

3. The fire protection system as in claim 2 wherein said crossover conduit is a closed ring-type conduit encircling the passenger cabin.

4. The fire protection system as in claim 3 wherein said distribution conduits include a plurality of closed ring-type crossover conduits spaced along the longitudinal axis of the aircraft.

5. The fire protection system as in claim 4 further including at least one pair of said self-sealing couplings mounted on the external fuselage on opposite sides of the aircraft and connected to one of said transverse conduits.

6. The fire protection system as in claim 1 wherein said distribution conduits are configured to supply each of said plurality of spray nozzles along at least two flow paths whereby a redundancy is achieved.

7. The fire protection system as in claim 6 further comprising a plurality of flow restrictors spaced along said longitudinal conduits between groups of said spaced spray nozzles.

8. The fire protection system as in claim 7 wherein each of said flow restrictors is configured to restrict the maximum flow rate of water to a value approximately that of the combined capacity of the downstream spray nozzles.

9. The fire protection system as in claim 1 further comprising means for limiting the flow of water in said distribution conduits in the event of a rupture in one of said plurality of distribution conduits upstream of one or more of said plurality of spray nozzles.

10. The fire protection system as in claim 1 wherein a pair of said self-sealing couplings are located one proximate the tip of each wing of the aircraft, the fire control system further comprising:

(i) a pair of flexible conduits one interconnecting each of said pair of self-sealing couplings to said distribution conduits, and (ii) a pair of non-return valves one positioned in each of said flexible conduits proximate the root of the respective wing.

* * * * *